US008059013B2

(12) United States Patent
Aono

(10) Patent No.: US 8,059,013 B2
(45) Date of Patent: Nov. 15, 2011

(54) COMMUNICATION APPARATUS

(75) Inventor: Hiroyuki Aono, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 209 days.

(21) Appl. No.: 12/516,941

(22) PCT Filed: Jan. 31, 2008

(86) PCT No.: PCT/JP2008/051982
§ 371 (c)(1),
(2), (4) Date: May 29, 2009

(87) PCT Pub. No.: WO2008/093889
PCT Pub. Date: Aug. 7, 2008

(65) Prior Publication Data

US 2010/0019933 A1 Jan. 28, 2010

(30) Foreign Application Priority Data

Feb. 2, 2007 (JP) ..... 2007-024497

(51) Int. Cl.
*G08G 1/09* (2006.01)

(52) U.S. Cl. ..... 340/905; 701/200

(58) Field of Classification Search ..... None
See application file for complete search history.

(56) References Cited

U.S. PATENT DOCUMENTS 5,839,086 A * 11/1998 Hirano ..... 701/201

FOREIGN PATENT DOCUMENTS

| | | |
|---|---|---|
| JP | A-06-112902 | 4/1994 |
| JP | A-08-086662 | 4/1996 |
| JP | A-08-180293 | 7/1996 |
| JP | A-2000-172985 | 6/2000 |
| JP | A-2000-182190 | 6/2000 |
| JP | A-2006-072613 | 3/2006 |
| JP | A-2008-158873 | 7/2008 |

* cited by examiner

*Primary Examiner* — Brian A Zimmerman
*Assistant Examiner* — Sara Samson
(74) *Attorney, Agent, or Firm* — Oliff & Berridge, PLC

(57) ABSTRACT

An object is to provide a communication device which can transmit different information for each lane in vehicle-to-roadside communications, while allowing vehicles to perform highly accurate position location. A communication device, placed on roadside, for transmitting information to a plurality of lanes, comprises a plurality of transmission means for respectively transmitting information to the plurality of lanes, and control means for causing the plurality of transmission means to simultaneously transmit common information to all the lanes and, during when the common information is not simultaneously transmitted, causing transmission means for a specific lane in the plurality of transmission means to transmit specific lane information having a content related to the specific lane while stopping transmission means for a lane adjacent to the specific lane in the plurality of transmission means from transmitting information; wherein the common information to be simultaneously transmitted contains at least a part of information making a line identifiable in the specific lane information in addition to information having a content common in all the lanes.

3 Claims, 7 Drawing Sheets

COMMUNICATION APPARATUS

TECHNICAL FIELD

The present invention relates to a communication device on roadside in vehicle-to-roadside communications.

BACKGROUND ART

As car navigation devices have been becoming widespread, the VICS (Vehicle Information Communication System) has come into use, while road traffic information such as traffic jam information has been supplied as VICS information to vehicles. For supplying the VICS information to the vehicles, vehicle-to-roadside communications and FM multiplex communications have been carried out. In the case of vehicle-to-roadside communications, optical beacons and the like are provided on the roadside, while receivers corresponding to the optical beacons and the like are mounted to the vehicles. In the case of an optical beacon, a head for transmitting/receiving data is provided in each lane and downlinks the VICS information common in all the lanes to each lane simultaneously.

It has further been contemplated to utilize optical beacons in order to assist driving by vehicle-infrastructure cooperative services. In an example of the vehicle-infrastructure cooperative services utilizing optical beacons, a vehicle performs position location according to data received from an optical beacon and calculates a distance from the vehicle to a stop line according to the position location. Then, the vehicle acquires signal information and carries out various driving assistances according to the information about the distance to the stop line and the signal information. The signal information includes cycle information about color lights and right-turn lights and the like, while details of information vary among lanes such as straight-through lanes and right-turn lanes. Therefore, for performing the vehicle-infrastructure cooperative services, information must be set for each lane, while it is necessary for the optical beacons to downlink different kinds of information from respective heads for the lanes, so as to provide different services for the respective lanes.

However, a part of a downlink area of a head corresponding to each lane of an optical beacon enters its adjacent beacon. Therefore, when the heads transmit different data for the respective lanes, the data may interfere with each other because of leakage from adjacent lanes, thus causing errors in reception, whereby necessary data may not be received totally. Hence, the communication device described in Patent Document 1 (Japanese Patent Application Laid-Open No. 2000-182190) transmits common data common in all the lanes to all the lanes and then, during when transmitting lane-specific data to a given lane, stops transmitting data to its adjacent lanes (i.e., performs time-division transmissions between lanes), thereby preventing data from interfering with each other between the lanes. Japanese Patent Application Laid-Open No. 8-86662 also discloses a communication device on the roadside.

DISCLOSURE OF THE INVENTION

For carrying out a driving assistance at an intersection in order to prevent collisions from occurring, it is necessary to determine the distance from the vehicle to the stop line with a high accuracy, whereby the position location must be performed with a high accuracy. However, since the above-mentioned communication device performs time-division transmissions between lanes, there are cases where data is transmitted and stopped from being transmitted when the vehicle enters a downlink area of an optical beacon. Therefore, the position at which data from the optical beacon is initially receivable in the downlink area by the vehicle may be located at an entrance edge of the downlink area or at a given position closer to the stop line than is the entrance edge, whereby the zero point for resetting the position location may fluctuate. In particular, as data per lane increases, the period in which data transmission is stopped becomes longer, so as to raise the possibility of the zero point fluctuating, thereby increasing errors in the distance from the zero point. This lowers the accuracy in position location and the accuracy in distance from the vehicle to the stop line.

It is therefore an object of the present invention to provide a communication device which can transmit different information for each lane in vehicle-to-roadside communications, while enabling highly accurate position location on the vehicle side.

The communication device in accordance with the present invention is a communication device, placed on roadside, for transmitting information to a plurality of lanes; the device comprising a plurality of transmission means for respectively transmitting information to the plurality of lanes, and control means for causing the plurality of transmission means to simultaneously transmit common information to all the lanes and, during when the common information is not simultaneously transmitted, causing transmission means for a specific lane in the plurality of transmission means to transmit specific lane information having a content related to the specific lane while stopping transmission means for a lane adjacent to the specific lane in the plurality of transmission means from transmitting information; wherein the common information to be simultaneously transmitted contains at least a part of information making a line identifiable in the specific lane information in addition to information having a content common in all the lanes.

This communication device is placed on roadside and carries out vehicle-to-roadside communications with a device on the vehicle side. For responding to vehicle-to-roadside communications for a plurality of lanes, the communication device comprises a plurality of transmission means for respectively transmitting information to the plurality of lanes and control means for controlling respective transmissions of the plurality of transmission means. Under the transmission control by the control means, the communication device causes the plurality of transmission means to transmit common information to all the lanes. Under the transmission control by the control means, during when the common information is not simultaneously transmitted, the communication device causes transmission means for a specific lane to transmit specific lane information while stopping transmission means for a lane adjacent to the specific lane from transmitting information. Hence, the common information is simultaneously transmitted to all the lanes, whereas specific lane information for each lane is transmitted in time division between the lanes. The common information is basically information having a content common in all the lanes. The specific lane information, which is set for each lane, is basically information for a specific lane and has a content different from that of other lanes. In particular, the specific lane information contains information by which a lane is identifiable, whereby to which lane the information corresponds can be determined on the vehicle side in the case of this information. In the communication device, at least a part of the information by which the lane is identifiable in the specific lane information is contained in the common information to be simultaneously transmitted, and is simultaneously transmitted to all the lanes as the common information. This can cut down the specific lane information to be transmitted in time division, shorten the period for time division, and reduce the stop period for time-division information transmission. The information transmission stop period can be made shorter as a greater amount of information by which a lane is identifiable in the specific lane information is contained in the common information. Thus, the information transmission stop period by time division can be made shorter, so as to lower the possibility of the position location reset zero point fluctuating when the position location is carried out on the vehicle side, and errors in the distance from the zero point can be reduced even when the zero point fluctuates. As a result, highly accurate position location can be performed, so that the position of the vehicle can be determined with a high accuracy. Further, by shortening the period for time division, the communication device can elongate the period for simultaneous transmission and increase the number of sessions for repeatedly transmitting the same common information. This raises the probability of receiving the common information (including a part of specific lane information) on the vehicle side.

Preferably, in the above-mentioned communication device in accordance with the present invention, the information transmitted during when the common information is not simultaneously transmitted is lane recognition information for recognizing a running lane on the vehicle side in the specific lane information.

This communication device simultaneously transmits common information containing information by which a lane is identifiable in the specific lane information to all the lanes, and transmits in time division the lane recognition information for recognizing the running lane on the vehicle side during when the simultaneous transmission is not performed. Upon receiving the common information and lane recognition information, the vehicle running on the specific lane can recognize the running lane according to the lane recognition information and can extract information for thus recognized lane from the information by which the lane is identifiable in the common information. Thus, the specific lane information for the running lane can easily be extracted from the common information on the vehicle side. By transmitting only the lane recognition information by time division, the communication device can make the time-division period as short as possible, thereby minimizing the information transmission stop period due to the time division.

Preferably, the above-mentioned communication device further comprises vehicle ID acquiring means for acquiring a vehicle ID of a vehicle, while the lane recognition information is information correlating the vehicle ID acquired by the vehicle ID acquiring means to lane information about a lane where the vehicle having the vehicle ID is running.

The vehicle transmits its own vehicle ID to the communication device on the roadside. In the communication device, the vehicle ID acquiring means acquires the vehicle ID. During when the simultaneous transmission is not performed, the communication device transmits in time division the information correlating the vehicle ID to information about the lane where the vehicle having the vehicle ID is running. Upon receiving the lane recognition information, the vehicle running on the specific lane can verify whether or not the information is one for the own vehicle and can recognize the running lane according to the lane information, thereby making it possible to extract information for thus recognized lane from information by which the lane is identifiable in the common information. Thus, the specific lane information for the running lane can easily be extracted from within the common information on the vehicle side.

BEST MODES FOR CARRYING OUT THE INVENTION

In the following, an embodiment of the communication device in accordance with the present invention will be explained with reference to the drawings.

In this embodiment, the communication device in accordance with the present invention is employed for an optical beacon utilized in a vehicle-to-roadside communication system which carries out at least vehicle-to-roadside communications by the optical beacon. The vehicle-to-roadside communication system in accordance with this embodiment functions as a system for providing VICS information and a vehicle-infrastructure cooperative system. The optical beacon in accordance with this embodiment can transmit/receive information to/from in-vehicle communication devices and supply vehicle-infrastructure cooperative information to the vehicle side.

Figure 1:
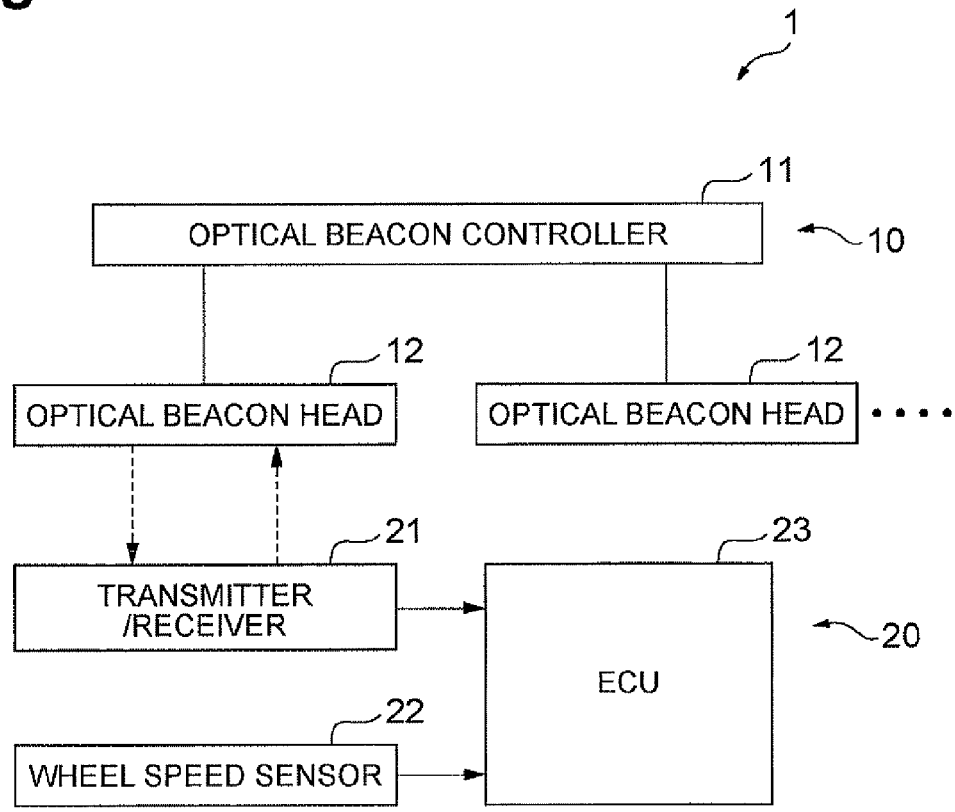
FIG. 1 is a configuration diagram of a vehicle-to-roadside communication system by an optical beacon in accordance with an embodiment.
Figure 2:
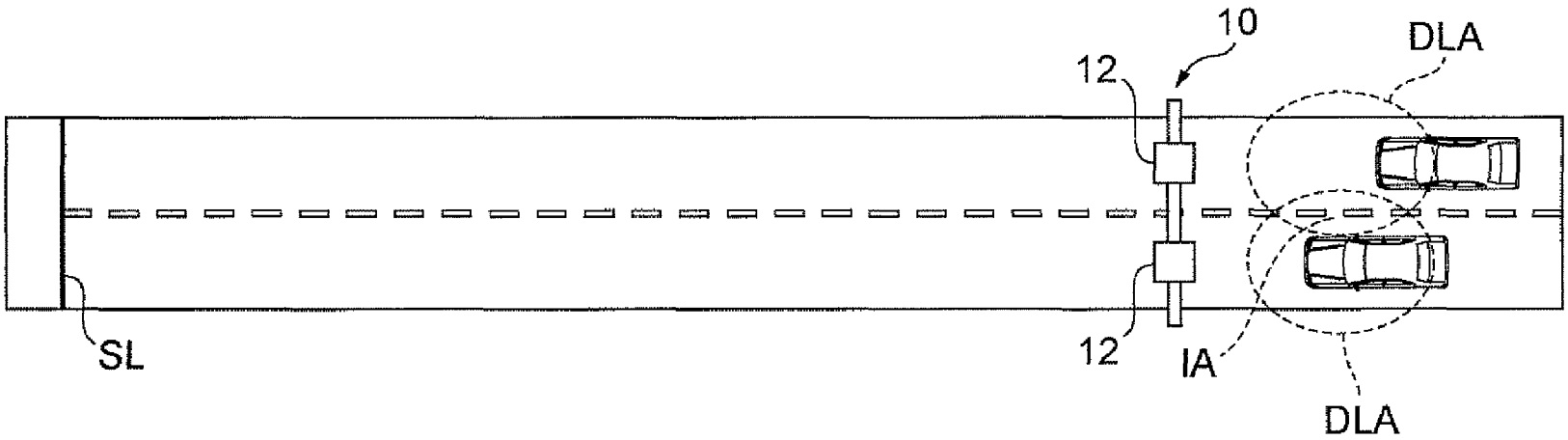
FIG. 2 is a plan view of the optical beacon in a case where there are two lanes each way.
Figure 3:
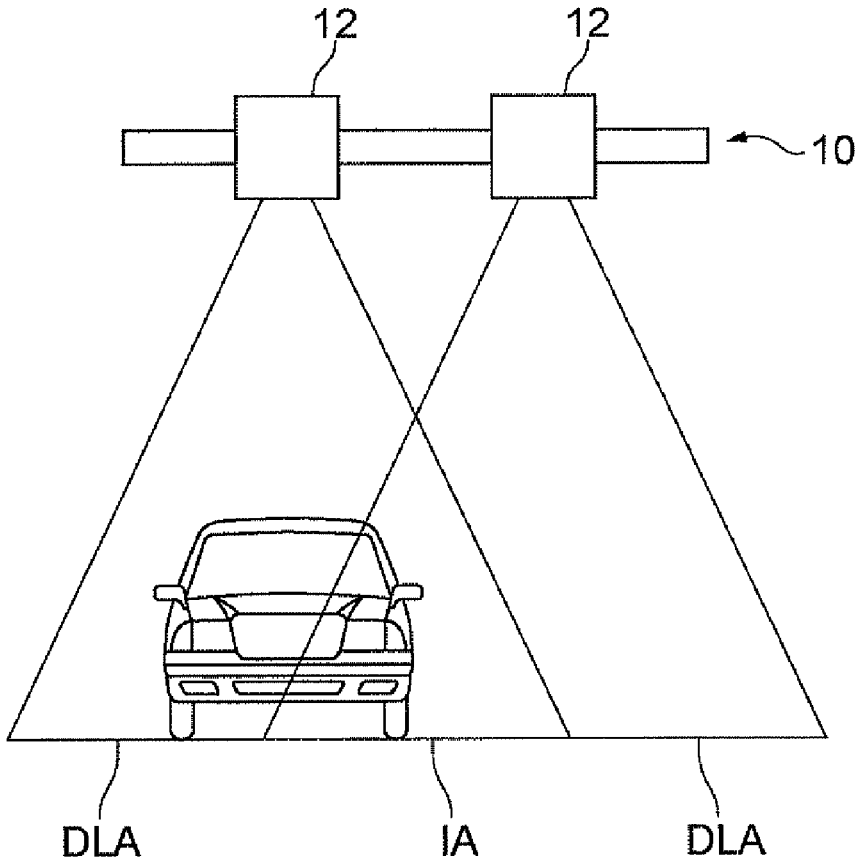
FIG. 3 is a front view of the optical beacon in the case where there are two lanes each way.

With reference to FIGS. 1 to 3, a vehicle-to-roadside communication system 1 will be explained. FIG. 1 is a configuration diagram of a vehicle-to-roadside communication system by an optical beacon in accordance with an embodiment. FIG. 2 is a plan view of the optical beacon in a case where there are two lanes each way. FIG. 3 is a front view of the optical beacon in the case where there are two lanes each way.

The vehicle-to-roadside communication system 1 comprises an optical beacon 10 placed on the roadside and an in-vehicle communication device 20 mounted in each vehicle. The optical beacon 10 is placed at a predetermined distance in front of an intersection or the like in general roads. The vehicle-to-roadside communication system 1 allows the optical beacon 10 and the in-vehicle communication device 20 to transmit/receive data therebetween by near-infrared rays, downlinks VICS information and vehicle-infrastructure cooperative information from the optical beacon 10 to the in-vehicle communication device 20, and uplinks vehicle ID information from the in-vehicle communication device 20 to the optical beacon 10.

The VICS information is road traffic information common in all the lanes. The road traffic information includes traffic jam information, traffic regulation information, parking information, and the like. The vehicle-infrastructure cooperative information includes signal cycle information for each lane and road alignment information, stop line information, speed limit information, and the like which are common in all the lanes. The signal cycle information includes the lighting time of each of green, yellow, and red lights, the lighting time of a right-turn light, the light currently on, the time passed after the light is turned on, and the like. It can be seen from the signal cycle information after how many seconds the red light will be turned on, and after how many seconds the right-turn light will be turned on and off in the case of a right-turn lane, for example. The road alignment information is constituted by information about nodes (changing points in the road) and information about links connecting the nodes. The node information includes positional information of the nodes and the like. The link information includes information about the distance, gradient, and the like of the links. The stop line information includes positional information and the like of stop lines. The distance from the optical beacon 10 (an entrance edge of a downlink area DLA) to a stop line SL can be obtained from the road alignment information and stop line information.

The downlink area DLA of the optical beacon 10 is set at K (m) (e.g., 0.5 m) in front of the optical beacon 10, while having an area size L (m) (e.g., 6.3 m) in the advancing direction of the lane with a width in the lane width direction slightly broader than the lane width. Therefore, the respective downlink areas DLA, DLA of adjacent lanes overlap each other, thereby yielding an overlapping area IA. The uplink area of the in-vehicle communication device 20 is set in front of the optical beacon 10 and has a size of M (m) (e.g., 4.0 m) in the advancing direction of the lane. The uplink area has an entrance edge at the same position as that of the downlink area DLA and is narrower than the downlink area DLA (L>M). These values K (m), L (m), and M (m) are those preset by a standard. Therefore, the distance from the optical beacon 10 to the entrance edge of the downlink area DLA is fixed.

Since the overlapping area IA exists, when different data are downlinked by adjacent lanes at the same time (see FIG. 4), the data leak to the adjacent lanes and interfere with each other. However, the interference with the adjacent lanes seems to occur only in the case of downlink. In other words, the uplink is transmitted in a narrow area because of the directivity of the in-vehicle communication device 20 at the time of transmission and thus hardly leaks to the adjacent lanes.

Figure 4:
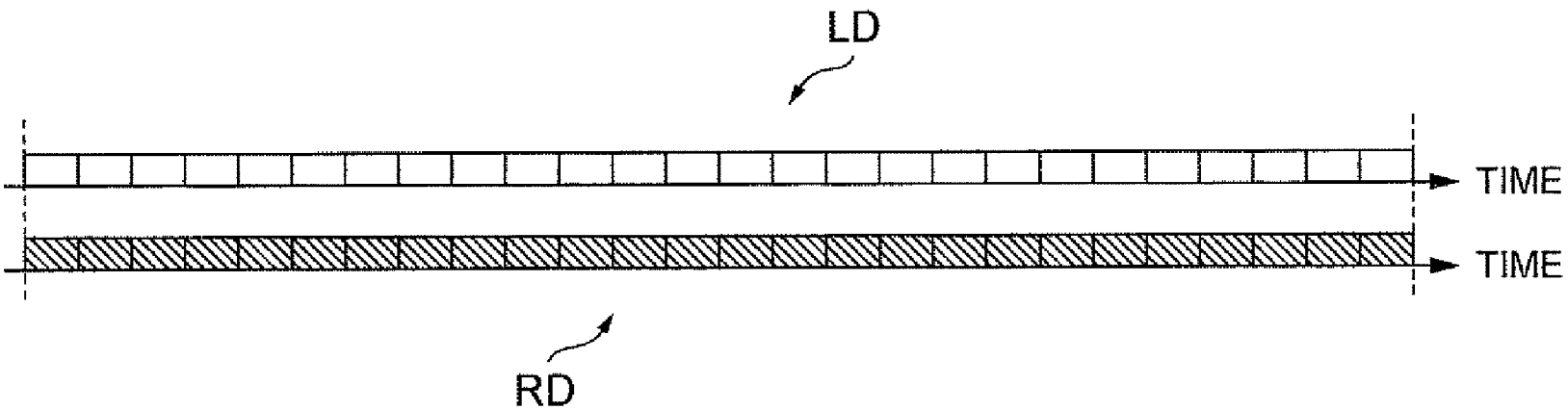
FIG. 4 is an example of downlink data per lane when respective optical beacon heads of lanes carry out simultaneous transmissions.
Figure 5:
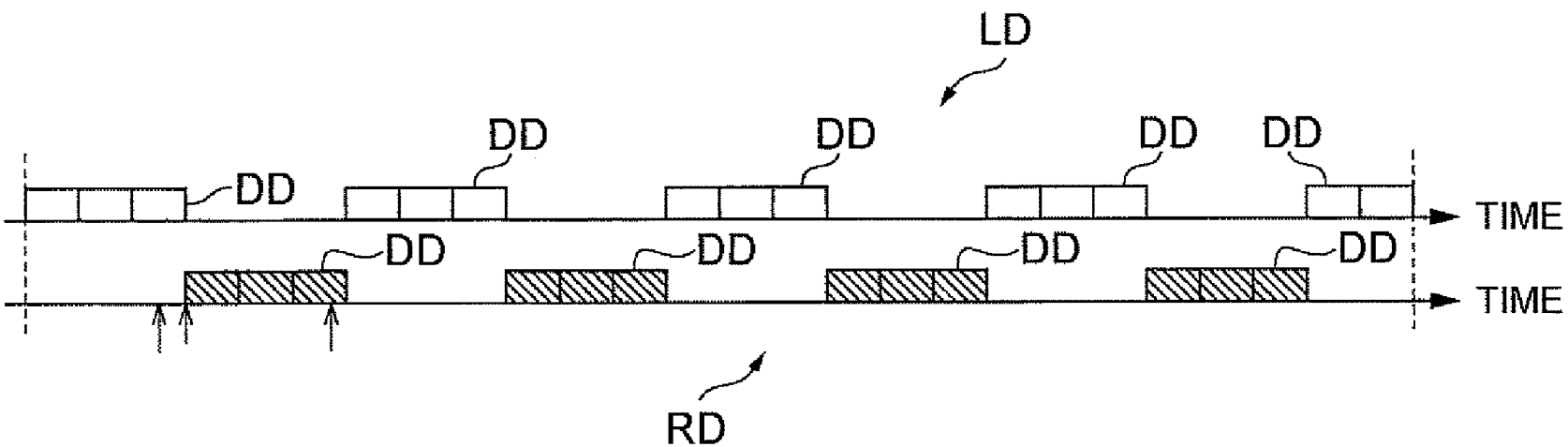
FIG. 5 is an example of downlink data per lane when respective optical beacon heads of two lanes perform time-division transmissions.
Figure 6:
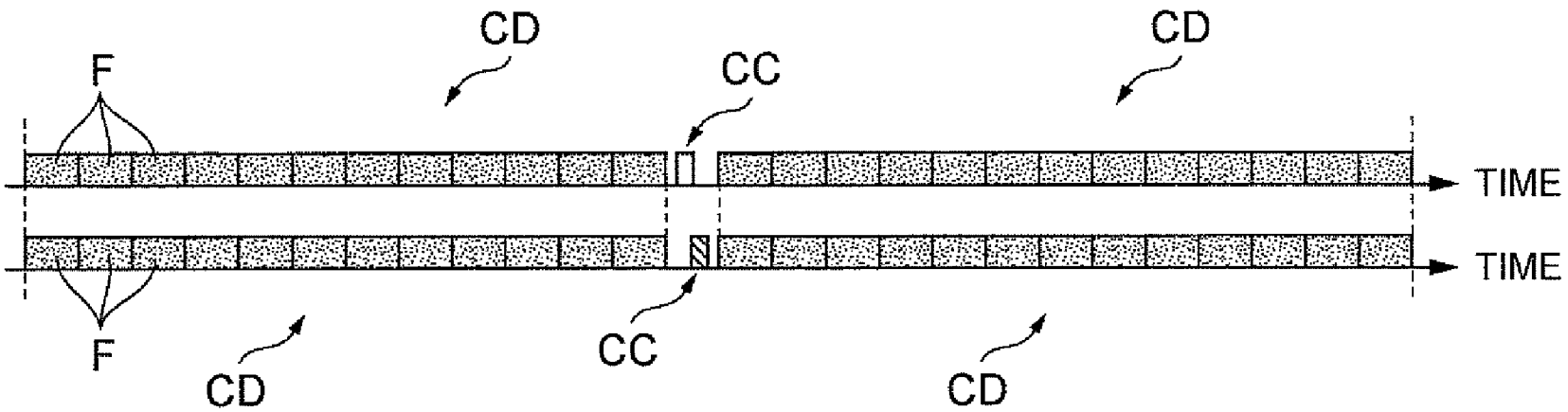
FIG. 6 is an example of downlink data per lane when respective optical beacon heads of two lanes perform simultaneous transmissions and time-division transmissions between the simultaneous transmissions.
Figure 7:
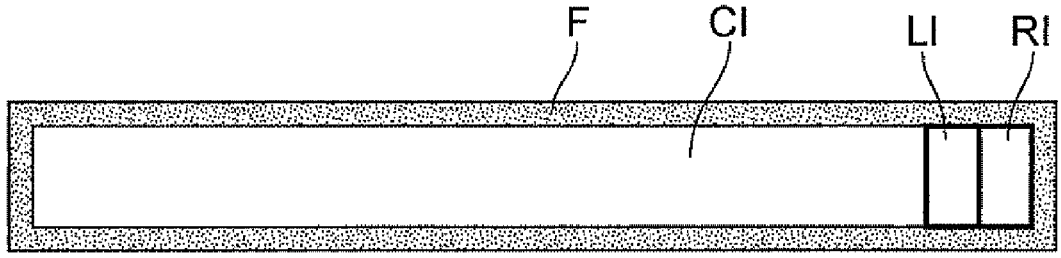
FIG. 7 is a structure of information in a frame of common data.

With reference to FIGS. 1 to 7, the optical beacon 10 will be explained. FIG. 4 is an example of downlink data per lane when respective optical beacon heads of two lanes carry out simultaneous transmissions. FIG. 5 is an example of downlink data per lane when respective optical beacon heads of two lanes perform time-division transmissions. FIG. 6 is an example of downlink data per lane when respective optical beacon heads of two lanes perform simultaneous transmissions and time-division transmissions between the simultaneous transmissions. FIG. 7 is a structure of information in a frame of common data.

The optical beacon 10 downlinks the VIC information and vehicle-infrastructure cooperative information to the downlink area DLA, while the vehicle ID information is uplinked to the optical beacon 10 from the vehicle running the uplink area. In particular, at the time of downlinking, the optical beacon 10 downlinks only a control channel in time division per lane and simultaneously downlinks the other kind of information to all the lanes. For this purpose, the optical beacon 10 comprises an optical beacon controller 11 and respective optical beacon heads 12, . . . for the lanes.

In this embodiment, the optical beacon controller 11 corresponds to the control means recited in the claims, while the respective optical beacon heads 12, . . . correspond to the plurality of transmission means and vehicle ID acquiring means recited in the claims.

Before explaining individual parts of the optical beacon 10, a downlinking method in the optical beacon 10 will be explained. In the case where there are two lanes each way, for example, when downlink data LD of the left lane and downlink data RD of the right lane are continuously downlinked at the same time, different data interfere with each other between the left and right lanes because of the overlapping area IA as shown in FIG. 4. When the data are downlinked in time division between the lanes in view of the above, there are cases where the vehicle reaches the entrance edge of the downlink area DLA with no time-division data DD, at the leading end of the time-division data DD, and within the time-division data DD as indicated by arrows in FIG. 5. Hence, it is uncertain at which position in the time-division data DD the vehicle reaching the entrance edge of the downlink area DLA can be received or not. Therefore, when resetting the position location, the zero point may shift from the entrance edge of the downlink area DLA, thereby yielding errors in the distance. Also, in the case of time division, the amount of downlinkable data becomes 1/(number of lanes), thereby being reduced. Thus, in the case of time division, the data efficiency becomes worse, and the accuracy in position location is lowered.

The information to downlink includes information varying between lanes such as road cycle information, but is mostly information common in all the lanes. Therefore, in order to shorten the period for downlinking in time division, the information to downlink is constructed as much as possible by common data CD common in all the lanes, and the common data is downlinked simultaneously for all the lanes. The VICS information and road alignment information, stop line information, speed limit information, and the like in the vehicle-infrastructure cooperative information intrinsically constitute common information and thus are employed as the common data CD. The signal cycle information, which is information per lane in the vehicle-infrastructure cooperative information, is also taken as the common data CD. For making it possible to identify to which lane each item of the signal cycle information corresponds, each item of the signal cycle information is provided with a lane number. Then, all of these kinds of information are employed as the common data CD, and the common data CD is divided into frames F. FIG. 7 shows an example of information structures stored in the frame F of the common data CD in the case where there are two lanes each way, in which originally common information CI such as road alignment information is stored in a most part of areas of the frames F, while signal cycle information LI provided with the lane number of the left lane and signal cycle information RI provided with the lane number of the right lane are stored in the remaining areas.

On the vehicle side, it is necessary to determine whether each item of the signal cycle information in the common data CD is information about the running lane or not. Therefore, it is necessary for the vehicle side to recognize the running lane. Hence, a control channel CC (lane recognition information) in which a lane number is added to the uplinked vehicle ID is generated for each lane, and only this control channel CC is downlinked in time division between the lanes. The control channel CC has a very small data amount and is constituted by only one frame. The frame time is very short, e.g., 1 ms according to an optical beacon standard.

FIG. 6 shows an example of downlinks in the case where there are two lanes each way. Usually, the common data CD is repeatedly downlinked for all the lanes. The respective control channels CC, CC for the lanes are generated at a predetermined period and downlinked only once in time division. Therefore, as for the common data CD, the same data is downlinked many times. The time-division downlink period is very short, and the downlink stop period is also very short. Hence, even when the vehicle reaches the entrance edge of the downlink area DLA during time division, so that the position location is reset, errors in the distance are very small and negligible. Here, when the vehicle reaches the entrance edge of the downlink area DLA during downlinking the common data CD, so that the position location is reset, there are no errors in the distance as a matter of course.

Though the control channel CC may be included in the common data CD so that all the information is simultaneously downlinked, only the control channel CC is downlinked in time division because of the following reason. When including the control channel CC in the common data CD, it is necessary for all the frames F to contain the control channel CC, whereby the amount of data storable in each frame is cut down accordingly. This increases the number of frames for downlinking one set of the common data CD. As a result, the number of sessions by which the common data CD can be downlinked within the downlink area DLA decreases, whereby the probability of reception on the vehicle side is lowered. It is also very wasteful, since all the frames F contain the same information (control channel CC).

As in the foregoing, information is made common as much as possible and repeatedly downlinked as the common data CD at the same time, while only the control channel CC minimally needed to recognize the running lane on the vehicle side is downlinked in time division. In the following, the individual parts of the optical beacon 10 will be explained specifically.

The optical beacon controller 11, which is an electronic control unit composed of a CPU (Central Processing Unit), a ROM (Read Only Memory), a RAM (Random Access Memory), and the like, controls the optical beacon 10 as a whole. The optical beacon controller 11 acquires the VICS information edited and processed in a VICS center and the signal cycle information from a controller (not depicted) of a traffic signal placed in front thereof The optical beacon controller 11 has already been keeping the road alignment information, stop line information, speed limit information, and the like around the optical beacon 10. Uplink data (vehicle ID) is fed into the optical beacon controller 11 from the optical beacon head 12.

The optical beacon controller 11 provides each item of the signal cycle information with the number of its corresponding lane. Then, the optical beacon controller 11 generates the common data CD from the individual items of information provided with the lane numbers, the VICS information, and the vehicle-infrastructure cooperative information other than the signal cycle information, and divides the common data CD into frames. The optical beacon controller 11 adds the lane number to the uplinked vehicle ID at each predetermined time, so as to generate the control channel CC per lane. The predetermined time may be either a fixed time or a variable time taking account of the amount of passage of vehicles, the vehicle speed, and the like. When no vehicle ID is uplinked, the vehicle ID of the control channel CC becomes null information.

The optical beacon controller 11 usually orders the optical beacons 12, . . . in all the lanes to downlink the common data CD for all the lanes, and repeats the same order each time when the downlink of the common data CD for one session ends. At each predetermined time, the optical beacon controller 11 orders the optical beacon head 12 for a lane to downlink to downlink the control channel CC for this lane, and orders the optical beacon head 12 in a lane adjacent to the former lane to stop downlinking for the latter lane. For example, time division is carried out between the left and right lanes when there are two lanes each way, between the center lane and the left and right lanes when there are three lanes each way, and between first and third lanes and between second and fourth lanes when there are four lanes each way.

The optical beacon head 12 is a head which is provided for each lane and adapted to transmit and receive near-infrared rays. The optical beacon head 12 is placed above the center line of the lane and inclined downward to the rear. Usually, in response to the order from the optical beacon controller 11, the optical beacon head 12 downlinks the common data CD into the downlink area DLA simultaneously with the other optical beacon heads 12. At each predetermined time, in response to the order from the optical beacon controller 11, the optical beacon head 12 downlinks and stops downlinking the control channel CC into the downlink area DLA. Also, the optical beacon head 12 receives the uplink data (vehicle ID information) from within the uplink area and outputs the uplink data to the optical beacon controller 11.

The in-vehicle communication device 20 will now be explained with reference to FIGS. 1 to 7. The in-vehicle communication device 20 downlinks the common data CD common in all the lanes and the control channel CC varying between the lanes when entering the downlink area DLA, and uplinks the vehicle ID data when entering the uplink area. The in-vehicle communication device 20 performs the position location according to the data reception in the downlink area DLA, thereby calculating the distance from the vehicle to the stop line. The in-vehicle communication device 20 supplies the VICS information to a navigation device, and the vehicle-infrastructure cooperative information constituted by the distance to the stop line, signal information, and the like to a driving assistance device. Therefore, the in-vehicle communication device 20 comprises a transmitter/receiver 21, a wheel speed sensor 22, and an ECU (Electronic Control Unit) 23.

The transmitter/receiver 21 is a device which can transmit and receive near-infrared rays. The transmitter/receiver 21 is placed at a predetermined position in the vehicle and inclined upward to the front. The transmitter/receiver 21 receives downlink data within the downlink area DLA and outputs the downlink data to the ECU 23. Also, in response to the order from the ECU 23, the transmitter/receiver 21 transmits uplink data within the uplink area.

The wheel speed sensor 22 is a sensor, provided with each wheel, for detecting wheel speed pulses. The wheel speed sensor 22 detects wheel speed pulses and outputs thus detected wheel speed pulses to the ECU 23.

The ECU 23 is an electronic control unit constituted by a CPU, a ROM, a RAM, and the like and controls the in-vehicle communication device 20 as a whole. The ECU 23 inputs the downlink data (common data CD and control channel CC) from the transmitter/receiver 21 and the wheel speed pulses from the respective wheel speed sensors 22 of the wheels. The ECU 23 calculates a vehicle speed V according to the wheel speed pulses of the wheels. When entering the uplink area, the ECU 23 generates uplink data constituted by the vehicle ID, and orders the transmitter/receiver 21 to uplink the uplink data.

When the transmitter/receiver 21 starts receiving the downlink data (resets the position location), the ECU 23 counts a time X from starting receiving the data until the calculation of the distance D to the stop line by the position location ends. Also, the ECU 23 extracts road alignment information from the common data CD and calculates the distance S from the entrance edge of the downlink area DLA to the stop line SL according to the road alignment information. Using the distance S and vehicle speed V determined by the calculations and the counted time X, the ECU 23 computes the distance D (=S−X×V) from the current vehicle position to the stop line SL.

Upon acquiring the control channel CC, the ECU 23 verifies whether it is information for the own vehicle or not according to the vehicle ID. When it is information for the own vehicle, the ECU 23 extracts the lane number from the control channel CC and recognizes the running lane. The ECU 23 performs collation according to the lane number and extracts the signal cycle information of the running lane from the common data CD. The ECU 23 also extracts the stop line information, speed limit information, and the like from the common data CD. The ECU 23 adds information about the distance D to the stop line to thus extracted information, so as to generate vehicle-infrastructure cooperative information. Then, the ECU 23 transmits the vehicle-infrastructure cooperative information to the driving assistance device.

The ECU 23 extracts the VICS information from the common data CD. Then, the ECU 23 transmits the VICS information to the car navigation device.

With reference to FIGS. 1 to 8, operations in the vehicle-to-roadside communication system 1 will be explained.

Each optical beacon head 12 of the optical beacon 10 receives the uplinked vehicle ID data. At each predetermined time, the optical beacon controller 11 generates the control channel CC constituted by the uplinked vehicle ID and the lane number.

The optical beacon controller 11 provides each item of the signal cycle information from the controller of the traffic light with lane information, generates the common data CD from the signal cycle information provided with the lane information, the VICS information from the VICS center, and the kept road alignment information, stop line information, speed limit information, and the like, and divides the common data CD into frames. Then, the optical beacon controller 11 repeatedly orders the optical beacon heads 12, . . . in all the lanes to downlink the common data CD in frame units. All the optical beacon heads 12, . . . downlink the common data CD into the downlink areas DLA.

Also, at each predetermined time, the optical beacon controller 11 orders the optical beacon head 12 for the lane to downlink to downlink the control channel CC, and orders the optical beacon head 12 in a lane adjacent to the former lane to stop downlinking. The optical beacon head 12 ordered to downlink downlinks the control channel CC into the downlink area DLA. On the other hand, the optical beacon head 12 ordered to stop downlinking stops downlinking.

As a consequence, the common data CD is repeatedly downlinked into the downlink area DLA at the same time, and the control channel CC for each lane is downlinked in time division in a very short period at each predetermined time between the downlinks of the common data CD.

The wheel speed sensor 22 of each wheel detects wheel speed pulses and transmits wheel speed pulse information to the ECU 23. The ECU 23 calculates the vehicle speed V according to the wheel speed pulses of the wheels.

When the vehicle mounted with the in-vehicle communication device 20 enters the downlink area DLA, the transmitter/receiver 21 repeatedly receives the common data CD, outputs the common data CD to the ECU 23 each time, receives the control channel CC once, and outputs the control channel CC to the ECU 23. When the vehicle enters the uplink area, the transmitter/receiver 21 uplinks the vehicle ID data in response to the order from the ECU 23.

Upon starting receiving data (resetting the position location), the ECU 23 counts the time passed from when starting receiving the data. The ECU 23 extracts road alignment information from the common data CD and calculates the distance S from the entrance edge of the downlink area DLA to the stop line SL according to the road alignment information. Also, from the counted time, the ECU 23 grasps the time X from when starting receiving the data to the end of the position location (current time). Then, by using the distance S from the entrance edge to the stop line SL, time X, and vehicle speed V, the ECU 23 calculates the distance D from the current own vehicle position to the stop line SL.

Upon verifying that the information is one for the own vehicle according to the vehicle ID of the control channel CC, the ECU 23 recognizes the running lane according to the lane number of the control channel CC. Then, the ECU 23 extracts the signal cycle information of the running lane from the common data CD according to the lane number, and extracts the stop line information, speed limit information, and the like from the common data CD. Thereafter, the ECU 23 transmits vehicle-infrastructure cooperative information in which information about the distance D to the stop line SL is added to thus extracted information to the driving assistance device. Also, the ECU 23 extracts the VICS information from the common data CD and transmits the VICS information to the car navigation device.

Once the vehicle-infrastructure cooperative information is provided, the driving assistance device judges whether or not the own vehicle can stop at the stop line SL upon the red light when running straightforward and whether or not the own vehicle can stop at the stop line SL with no right-tun light on when turning right, and calls for attention, alarms, controls brake intervention, and so forth when judged to be unstoppable.

This vehicle-to-roadside communication system 1 can prevent data from interfering with each other between lanes and provide the vehicle with different data for the respective lanes, thereby enabling vehicle-infrastructure cooperative services.

In particular, by employing information other than the control channel CC as the common data CD and downlinking the common data CD simultaneously for all the lines, the optical beacon 10 can make the time division period very short, whereby the downlink stop period in time division can become very short. As a consequence, when the position location is performed in the in-vehicle communication device 20, the possibility of the position location reset zero point fluctuating becomes lower, and errors in the distance from the zero point become very small even when the zero point fluctuates. This makes it possible to perform highly accurate position location, whereby the distance D to the stop line SL can be determined with a high accuracy. As a result, high-quality vehicle-infrastructure cooperative services can be carried out.

Further, by downlinking the control channel CC only once in time division, the optical beacon 10 can reduce the number of frames necessary for downlinking the common data CD for one session. This allows the in-vehicle device 20 to receive the same common data CD a greater number of times within the downlink area DLA, thereby improving the probability of reception. Therefore, even when the reception is temporarily hindered by a shielding object or the like, the common data CD can be acquired reliably.

By employing only the control channel CC as information to downlink in time division, the optical beacon 10 can make the time-division period as short as possible, whereby the downlink stop period by time division can be minimized. Also, by including the lane number in the control channel CC and correlating the lane number to each item of the signal cycle information, the optical beacon 10 makes it easy for the in-vehicle communication device 20 to extract the signal cycle information for the running lane from the common data CD.

Though an embodiment in accordance with the present invention has been explained in the foregoing, the present invention is carried out in various modes without being restricted to the above-mentioned embodiment.

For example, while the above-mentioned embodiment is employed for a vehicle-to-roadside communication system based on optical beacons, the present invention is also applicable to other vehicle-to-roadside communication systems such as those with radio beacons. The communication device of the present invention is employed for optical beacons but may also be applicable to other devices such as radio beacons.

Though the above-mentioned embodiment is constructed such as to uplink the vehicle ID from the vehicle side, receive the vehicle ID by the optical beacon, and downlink the control channel composed of the vehicle ID and the lane number in time division, the lane recognition information (e.g., a control channel constituted by the lane number alone) for recognizing the running lane on the vehicle side may be downlinked in time division by the optical beacon without uplinking and receiving the vehicle ID.

Though the above-mentioned embodiment is constructed such as to downlink only the control channel as specific lane information in time division, other information needed to downlink, if any, may also be downlinked in time division. It will be preferred if the amount of information to downlink in time division is as small as possible in this case as well.

Though the above-mentioned embodiment is constructed such as to downlink the same control channel only once, it may be downlinked a plurality of times at intervals in order to improve the probability of reception on the vehicle side.

Though the above-mentioned embodiment is constructed such as to downlink the control channel at each predetermined time, it may be downlinked at a timing when the vehicle ID is acquired and the like.

INDUSTRIAL APPLICABILITY

By including a part of specific lane information in the common information to be transmitted simultaneously, the communication device in accordance with the present invention can shorten time-division transmission periods (time-division information transmission stop periods in particular), thereby making it possible to transmit different kinds of specific lane information for respective lanes in vehicle-to-roadside communications and perform highly accurate position location on the vehicle side.

The invention claimed is:

1. A communication device, placed on roadside, for transmitting information to a plurality of lanes, the device comprising:

a plurality of transmission means for respectively transmitting information to the plurality of lanes; and control means that is programmed to:

cause the plurality of transmission means to simultaneously transmit common information to all the lanes during at least a first time period; and cause transmission means for a specific lane to transmit lane identification information during at least a second time period, wherein:

transmission means for lanes adjacent to the specific lane do not transmit during the second time period, the common information and the lane identification information are not transmitted during the same time period, the common information comprises information common to all lanes and information specific to specific lanes, and information specific to a lane is programmed to be extracted from the common information using the lane identification information.

2. A communication device according to claim 1, wherein the lane identification information is used to identify a running lane on a vehicle side.

3. A communication device according to claim 2, further comprising vehicle ID acquiring means for acquiring a vehicle ID of a vehicle;

wherein the lane identification information of the lane in which the vehicle having the vehicle ID is running is correlated with the acquired vehicle ID.

* * * * *